United States Patent [19]

Weinrich

[11] 3,960,245

[45] June 1, 1976

[54] LUBRICATING AND SEALING LIQUID FOR A HIGH PRESSURE COMPRESSOR

[75] Inventor: Hellmut Weinrich, Konigsbronn-Zang, Germany

[73] Assignee: Gutehoffnungshutte Sterkrade Aktiengesellschaft, Germany

[22] Filed: Jan. 29, 1975

[21] Appl. No.: 545,205

[30] Foreign Application Priority Data

Jan. 30, 1974 Germany ..... 2404270

[52] U.S. Cl. ..... 184/6.16; 417/366

[51] Int. Cl.[2] ..... F01B 35/00

[58] Field of Search ..... 184/6, 6.16, 6.28; 415/104, 105, 106, 107, 100; 417/365, 366, 368

[56] References Cited

UNITED STATES PATENTS 3,617,156 11/1971 Schiele ..... 415/104

*Primary Examiner*—Richard C. Pinkham
*Assistant Examiner*—Marvin Siskind
*Attorney, Agent, or Firm*—McGlew and Tuttle

[57] ABSTRACT

The compressor includes a housing defining a pressure space including chambers and passages connected thereto for conveying sealing and lubrication liquid to and from an impeller shaft rotatably mounted in the housing. The impeller shaft is stepped and mounted for limited radial movement, and includes an elastically bendable torsion shaft portion having a diameter which is a minimum with respect to the torsional stresses imposed thereon. A relieving piston is carried by the torsion shaft portion and the impeller shaft further includes a main compressor shaft portion carrying at least one impeller. A torsion shaft sealing surrounds the torsion shaft portion and serves as the main sealing forming a shield between the pressure within the pressure space and atmospheric pressure. A sleeve surrounds the relieving piston and is formed with axially spaced grooves in its surface facing the relieving piston, and annular discs are mounted on the relieving piston and cooperate with the grooves to compensate the axial thrust. A chamber is defined, on the one hand, by the torsion shaft portion and the torsion shaft sealing end, on the other hand, by the relieving piston, the sleeve and the housing, and a supply conduit is connected to this chamber to supply sealing and lubricating liquid thereto serving to absorb the internal pressure within the housing.

9 Claims, 1 Drawing Figure

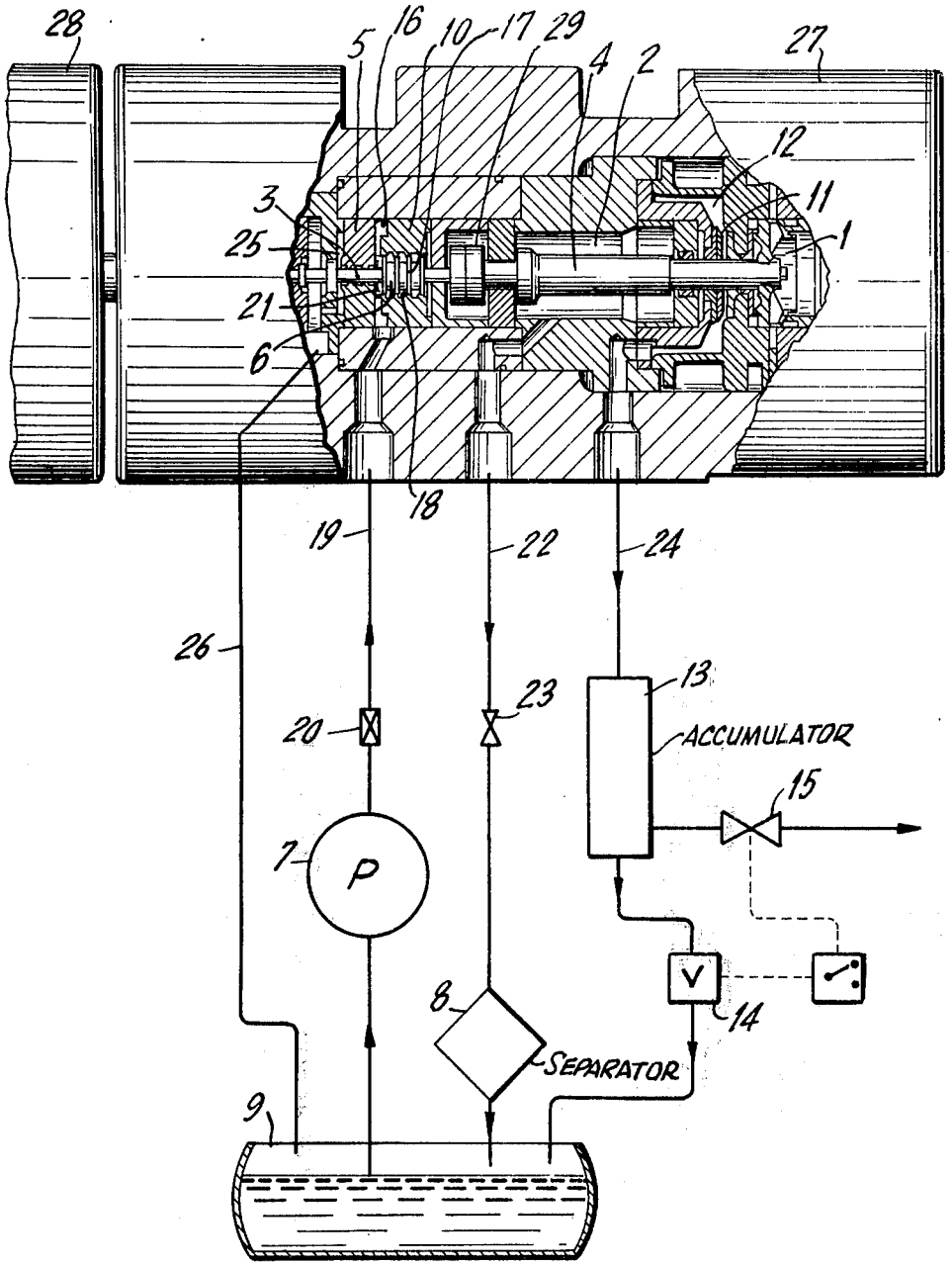
28
5
16
10
17
29
4
2
27
12
11
1
3
25
21
6
18
19
22
24
26
13
ACCUMULATOR
23
20
15
7
P
V
14
8
SEPARATOR
9

LUBRICATING AND SEALING LIQUID FOR A HIGH PRESSURE COMPRESSOR

FIELD AND BACKGROUND OF THE INVENTION

The present invention relates to a high-pressure compressor comprising chambers and passages connected thereto which are intended to convey a sealing and lubricating liquid to and from the impeller shaft.

There are known high pressure compressors in which no sealing liquid is needed. They comprise a common housing for the drive engine and the compressor proper and are provided with a main sealing behind the main shaft of the compressor, immediately in front of the impellers. In this case, because the engine is built in the housing, its performance is limited. The maximum available performances are about 700 kW and up to 3000 r.p.m. Such outputs are no longer sufficient in view of the actual trend to larger synthesis plants. With the double or fourfold performances required, however, the mounting of the engines into the pressure space becomes too expensive.

SUMMARY OF THE INVENTION

The present invention is directed to a high-pressure compressor for circulating a gas or a liquid at pressures above 200 atm in excess of atmospheric pressure, avoiding the mentioned drawbacks, providing higher performances and constructed at low expense.

The invention starts from the idea that the mounting of the engine and compressor or pump in a common housing must be abandoned in order to avoid the otherwise given limitation of the engine performance. Further, to minimize the costs, the machine should be designed for small increases of pressure, single stage, and an overhung position, which entails problems so as to the sealing and the absorption of the axial thrust depending on the pressure and cross-sectional area of the drive shaft.

In accordance with the invention, there is provided a high-pressure compressor in which the stepped impeller shaft, radially movable within limits and mounted in the pressure space, is designed as a shaft means made in one piece or assembled of parts, and which, considered from the power input end, comprises an elastically bendable torsion shaft, having a diameter which is a minimum or as small as possible with regard to the occurring torsional stresses, and carrying a relieving piston, followed by the main compressor shaft carring the impeller or impellers. The torsion shaft sealing surrounding the torsion shaft is designed as the main sealing serving as a shield between the inner space pressure and the atmospheric pressure. To compensate the axial thrust, annular discs are mounted on the relieving piston and cooperate with grooves provided in a sleeve surrounding the relieving piston. A chamber for a sealing and lubricating liquid, fed in through a supply conduit and serving to absorb the internal pressure in the housing, is provided between the torsion shaft and the torsion shaft sealing, on the one hand, and the relieving piston, the sleeve of the relieving piston, and the housing, on the other hand.

According to a development of the invention, a standstill stop fixture for the relieving piston is provided in the chamber on the torsion shaft sealing.

Moreover, in accordance with the invention, a draining conduit, comprising a pressure control valve and a liquid separator, is provided between the inner space of the bearing body surrounding the main portion of the main compressor shaft and a tank.

According to a further development of the invention, a chamber is provided between the housing and the main shaft sealing at the end of the main compressor shaft, and is connected, through an outlet conduit and an accumulator, either to the tank through a valve or to an open outlet where the outflow is controlled by a throttle system which also controls the valve mounted in the conduit leading to the tank. This chamber is supplied with the sealing and lubricating liquid, absorbing the internal pressure in the housing from the tank, through a pressure-responsive pump having a piston characteristic and through a conduit comprising a check valve.

An object of the invention is to provide an improved high-pressure compressor.

Another object is to provide such a high-pressure compressor avoiding the disadvantages of the prior art, providing higher performances, and constructed at a low expenditure.

A further object of the invention is to provide such a high-pressure compressor in which the driving engine and the compressor are not mounted in a common housing.

Another object of the invention is to provide such a high-pressure compressor which is designed for small increases of pressure, single stage, and an overhung position, and which includes improved sealing means and improved means for absorbing the axial thrust.

For an understanding of the principles of the invention, reference is made to the following description of a typical embodiment thereof as illustrated in the accompanying drawing.

BRIEF DESCRIPTION OF THE DRAWING

In the Drawing:

The single FIGURE is a diagrammatical sectional view of a high-pressure compressor embodying the invention.

DESCRIPTION OF THE PREFERRED EMBODIMENT

As shown in the drawing, the housing 27 of the compressor accommodates a shaft member which, considered in the sequential order from the power input side from motor or engine 28, comprises a torsion shaft 3, carrying a relieving piston 6, and the main compressor shaft 4 coupled to shaft 3, or integral therewith, and carrying the impellers 1.

Only the torsion shaft 3 is surrounded by a torsion shaft sealing 5 which is designed as the main sealing. Torsion shaft 3 is almost free from bending stresses and does not substantially affect the critical speed of main compressor shaft 4. The drive by means of a torsion shaft 3 makes it possible to minimize the diameter of torsion shaft sealing 5 and, thereby, to obtain the minimum axial thrust. Torsion shaft 3 serves as the drive member transmitting the torque to main compressor shaft 4. Due to the small diameter of the torsion shaft, the consumption of sealing means is minimized.

Torsion shaft 3 is followed by a relieving piston 6 carrying annular discs 17 and cooperating with a surrounding sleeve 10 provided with axially spaced grooves 18 facing discs 17 to absorb the axial thrust. Between relieving piston 6, sleeve 10 of the relieving piston and the housing, on the one hand, and torsion shaft 3 and torsion shaft sealing 5, on the other hand, a chamber 16 is formed into which the sealing or lubricating liquid is supplied.

In the present example, the sealing or lubricating liquid, such as oil or water, is supplied from a tank 9 by means of a pressure-responsive pump 7 having a piston characteristic and under a pressure which, of course, exceeds the compressor pressure, through a supply conduit 19 comprising a check valve 20.

Chamber 16 is completely filled with the sealing and lubricating liquid. The sealing and lubricating liquid received in chamber 16 takes the axial thrust from relieving piston 6 and annular discs 17 carried thereon as a pressure, and thereby suffers a compression which, in accordance with the difference between the loaded surfaces, manifests itself as an internal pressure exceeding the gas pressure of the fluid delivered by impellers 1.

Consequently, a portion of the sealing and lubricating liquid is pressed through between torsion shaft 3 and torsion shaft sealing 5 and passes through chamber 25, located in advance of torsion shaft sealing 5, and through conduit 26 back into tank 9.

The main portion of the sealing and lubricating liquid, however, passes into the space between relieving piston 6 and sleeve 10 and therefrom either through passages into the individual bearings or, along the main shaft, into the inner space 2 of the bearing body.

To what extent the inner space 2 of the bearing body will fill up will depend on the given circumstances. It may fill completely. However, it is also possible that only a reduced volume of liquid will accumulate corresponding to the withdrawal taking place through draining conduit 22, pressure control valve 23 and separator 8 into tank 9 which is under a lower pressure.

In cases where, due to the given pressure conditions, inner space 2 of the bearing body contains larger quantities of liquid or is completely filled, a portion of the liquid will also penetrate through sealing 11 of main compressor shaft 4 to following chamber 12. Therefrom, this portion of liquid will be drained through conduit 24 into an accumulator 13 wherefrom the further discharge is controlled by valve 14. Subsequently, of course, this portion of the liquid may also be recirculated to tank 9. Otherwise, it is passed by throttle system 15 to an open outlet.

It is a matter of course that tank 9 itself is under a lower pressure than the chambers and the shafts. At very high pressure, it may happen that the specific weight of the gas reaches approximately the order of magnitude corresponding to the specific weight of the liquid. In such a case, inner space 2 of the bearing body is to be filled with liquid completely and care must be taken, by means of an additional pressure control valve 23, to maintain the pressure within the inner space 2 of the bearing body approximately 0.5 to 1.0 atm. above the gas pressure.

As soon as, at the outlet of accumulator 13 to throttling system 15, the gas escapes along with the liquid, the lowermost level of liquid in the accumulator is attained. In such a case, the pressure variation in throttling system 15 is no longer linear and the pressure increases considerably before the last throttle. This pressure increase can be used for the control of valve 14 through which the largest portion of the liquid must be drained. Valve 14 may be a solenoid valve with delayed opening or a hydraulically or pneumatically controlled valve.

During stopping of the compressor and of pump 7, only the gas pressure in the interior of the compressor housing is effective and displaces the impeller shaft until relieving piston 6 applies against a stop fixture 21 provided on torsion shaft sealing 5 and seals the pressure space against the atmosphere, possibly also without any sealing liquid, as a standstill sealing.

Torsion shaft 3, which is coaxial with main compressor shaft 4, may either be integral with shaft 4 or may be coupled thereto by a coupling, such as indicated at 29.

While a specific embodiment of the invention has been shown and described in detail to illustrate the application of the principles of the invention, it will be understood that the invention may be embodied otherwise without departing from such principles.

What is claimed is:

1. In a high-pressure compressor including a housing defining a pressure space including chambers and passages connected thereto for conveying sealing and lubricating liquid to and from an impeller shaft rotatably mounted in the housing, the improvement comprising, in combination, a stepped impeller shaft mounted in said pressure space for limited radial movement; said shaft comprising, from its power input end, an elastically bendable torsion shaft portion having the minimum diameter effective to support only the torsional stresses impressed thereon, a relieving piston carried by said torsion shaft portion, a main compressor shaft portion, and at least one impeller carried by said main compressor shaft portion; a torsion shaft sealing surrounding said torsion shaft portion and serving as the main sealing forming a shield between the pressure within said pressure space and atmospheric pressure; a sleeve surrounding said relieving piston and formed with axially spaced grooves in its inner surface facing said relieving piston; annular discs mounted on said relieving piston and facing said grooves, said discs compensating the axial thrust; a chamber defined, on the one hand, by said torsion shaft portion and said torsion shaft sealing and, on the other hand, by said relieving piston, said sleeve and said housing; a supply conduit connected to said last-named chamber and supplying sealing and lubricating liquid thereto serving to absorb the internal pressure within said housing; a bearing body surrounding the major portion of said main compressor shaft portion; a sealing and lubricating liquid-receiving tank; a draining conduit connecting the inner space of said bearing body to said tank; and a pressure-control valve and a liquid separator connected in series in said draining conduit.

2. In a high-pressure compressor, the improvement claimed in claim 1, in which said torsion shaft portion is integral with said main compression shaft portion.

3. In a high-pressure compressor, the improvement claimed in claim 1, including a coupling connecting said torsion shaft portion to said main compressor shaft portion.

4. In a high-pressure compressor, the improvement claimed in claim 1, including a standstill stop fixture, for said relieving piston, provided on said torsion shaft sealing.

5. In a high-pressure compressor, the improvement claimed in claim 1, including a tank for receiving sealing and lubricating liquid; said sealing and lubricating liquid being supplied to said last-named chamber through said supply conduit by a pressure-controlled pump connected between said tank and said supply conduit; and a check valve in said supply conduit between said pump and said last-named chamber.

6. In a high-pressure compressor, the improvement claimed in claim 5, in which said pressure-control pump has a piston characteristic.

7. In a high-pressure compressor including a housing defining a pressure space including chambers and passages connected thereto for conveying sealing and lubricating liquid to and from an impeller shaft rotatably mounted in the housing, the improvement comprising, in combination, a stepped impeller shaft mounted in said pressure space for limited radial movement; said shaft comprising, from its power input end, an elastically bendable torsion shaft portion having the minimum diameter effective to support only the torsional stresses impressed thereon, a elieving piston carried by said torsion shaft portion, a main compressor shaft portion, and at least one impeller carried by said main compressor shaft portion; a torsion shaft sealing surrounding said torsion shaft portion and serving as the main sealing forming a shield between the pressure within said pressure space and atmospheric pressure; a sleeve surrounding said relieving piston and formed with axially spaced grooves in its inner surface facing said relieving piston; annular discs mounted on said relieving piston and facing said grooves, said discs compensating the axial thrust; a chamber defined, on the one hand, by said torsion shaft portion and said torsion shaft sealing and, on the other hand, by said relieving piston, said sleeve and said housing; a supply conduit connected to said last-named chamber and supplying sealing and lubricating liquid thereto serving to absorb the internal pressure within said housing; a main compressor shaft sealing mounted at the end of said main compressor shaft portion nearest said impeller; a second chamber defined between said housing and said main compressor shaft sealing; an accumulator; an outlet conduit connecting said second chamber to said accumulator; a tank for receiving sealing and lubricating liquid; first means operable to connect said accumulator to said tank; and second means operable to connect said accumulator to an open outlet.

8. In a high-pressure compressor, the improvement claimed in claim 7, in which said first means comprises a valve; said second means comprising a throttling system controlling the flow through said open outlet.

9. In a high-pressure compressor, the improvement claimed in claim 8, in which said throttling system controls said valve.

* * * * *